US008739544B2

(12) United States Patent
Rawlinson et al.

(10) Patent No.: US 8,739,544 B2
(45) Date of Patent: Jun. 3, 2014

(54) STAGING VALVE ARRANGEMENT AND VALVE FOR USE THEREIN

(75) Inventors: Neil Rawlinson, Kenilworth (GB); Michael Robert Lyons, Solihull (GB); William Keith Bradbury, Solihull (GB); Laurence Alden, Droitwich Spa (GB); Blair Ramsay, Barford (GB); Mark Scully, Derby (GB)

(73) Assignee: Rolls-Royce Controls and Data Services Limited, Derby (GB)

( * ) Notice: Subject to any disclaimer, the term of this patent is extended or adjusted under 35 U.S.C. 154(b) by 1101 days.

(21) Appl. No.: 12/748,841

(22) Filed: Mar. 29, 2010

(65) Prior Publication Data

US 2010/0252758 A1 Oct. 7, 2010

(30) Foreign Application Priority Data

Apr. 2, 2009 (GB) ..... 0905710.0

(51) Int. Cl.

| | |
|---|---|
| ***F02C 1/10*** | (2006.01) |
| ***F02G 1/055*** | (2006.01) |
| ***F02C 9/52*** | (2006.01) |
| ***F16K 31/00*** | (2006.01) |
| ***F16K 47/00*** | (2006.01) |
| ***F16L 53/00*** | (2006.01) |

(52) U.S. Cl.

USPC ..... 60/734; 60/39.281; 251/129.06; 251/129.11; 137/339

(58) Field of Classification Search

USPC ..... 60/734, 39.281; 251/129.06, 129.11; 137/339

See application file for complete search history.

(56) References Cited

U.S. PATENT DOCUMENTS

| | | | | |
|---|---|---|---|---|
| 5,544,478 | A * | 8/1996 | Shu et al. | 60/773 |
| 5,881,550 | A * | 3/1999 | Toelle | 60/39.094 |
| 6,216,677 | B1 * | 4/2001 | McConnell et al. | 123/568.24 |
| 6,435,169 | B1 * | 8/2002 | Vogt | 123/568.23 |
| 6,581,903 | B2 * | 6/2003 | Yokoyama et al. | 251/129.11 |
| 6,810,674 | B2 * | 11/2004 | Clements | 60/773 |
| 6,981,359 | B2 * | 1/2006 | Wernberg et al. | 60/39.281 |
| 6,989,574 | B2 * | 1/2006 | Parsons | 257/417 |
| 7,007,476 | B2 * | 3/2006 | Mains et al. | 60/734 |
| 7,036,302 | B2 * | 5/2006 | Myers, Jr. et al. | 60/39.281 |

(Continued)

FOREIGN PATENT DOCUMENTS

| | | |
|---|---|---|
| EP | 2063087 | 5/2009 |
| EP | 2143911 | 1/2010 |

OTHER PUBLICATIONS

European Search Report for Application No. 10 250 666.4 dated Apr. 20, 2012.

*Primary Examiner* — William H Rodriguez
*Assistant Examiner* — Karthik Subramanian
(74) *Attorney, Agent, or Firm* — Oliff PLC

(57) ABSTRACT

A staging valve arrangement is described that comprises an arrangement of electrically driven staging valves that are located, in use, in the high temperature core zone of an engine. Each staging valve may comprise a housing having an inlet, a pilot flow outlet and a mains flow outlet, a valve member movable between a closed position in which the mains flow outlet is closed and an open position in which the mains flow outlet is open, a motor operable to drive the valve member for movement, and a cooling arrangement.

9 Claims, 3 Drawing Sheets

(56) References Cited

U.S. PATENT DOCUMENTS

| | | | | |
|---|---|---|---|---|
| 7,096,658 | B2 * | 8/2006 | Wernberg et al. | 60/39.281 |
| 7,137,242 | B2 * | 11/2006 | Griffiths | 60/243 |
| 2002/0002818 | A1 * | 1/2002 | Badeer | 60/39.06 |
| 2003/0154722 | A1 * | 8/2003 | Mistry et al. | 60/776 |
| 2005/0284148 | A1 * | 12/2005 | Wernberg et al. | 60/734 |
| 2005/0284149 | A1 * | 12/2005 | Jansen et al. | 60/734 |
| 2009/0126802 | A1 * | 5/2009 | Rawlinson | 137/98 |
| 2012/0227842 | A1 * | 9/2012 | Griffiths et al. | 137/561 A |

* cited by examiner

STAGING VALVE ARRANGEMENT AND VALVE FOR USE THEREIN

This invention relates to an arrangement of staging valves for use in controlling the delivery of fuel to an aircraft engine, and to a valve for use therein.

There is a move towards reducing the environmental impact of aircraft engines by reducing harmful emissions (CO and NOX), and one way in which this can be achieved is through the use of staging valves to control the delivery of fuel to the engine. In one such arrangement the staging valve operates to determine whether fuel is delivered to the engine just through a pilot burner or whether it is delivered through a mains burner.

A fuel staging system is described in EP 2063087 which includes a fuel pressure controlled valve arrangement operable to control the supply of fuel to the mains burner. A boost pump and relatively complex splitter valve are used to vary a control pressure applied to a control valve associated with the burners to determine whether fuel delivery takes place just though the pilot burner or whether delivery through the mains burner is permitted. Such a system is thought to be disadvantageous in that the splitter valve is of relatively complex form, the need to provide a boost pump adds extra complexity to the system, and the need to provide additional pipework for the various control lines further complicates the system. Also, in use, a significant quantity of fuel is present in the lines within the high temperature core zone of the engine. Lacquering of stagnant fuel within these lines significantly impacts upon system performance.

It is an object of the invention to provide an arrangement of staging valves whereby at least some of the disadvantages outlined hereinbefore can be overcome or the disadvantages thereof are of reduced effect. It is a further object of the invention to provide a means of controlling the arrangement of staging valves whereby the fuel efficiency of the staged combustion process is improved. Another object of the invention is to provide a staging valve suitable for use in such an arrangement.

According to the present invention there is provided a staging valve arrangement comprising an arrangement of electrically driven staging valves that are located, in use, in the high temperature core zone of an engine.

Preferably each staging valve includes an integrated motor.

Preferably each staging valve is integrated into the design of a corresponding burner assembly located on the engine combustor.

Preferably, each staging valve comprises a housing having an inlet, a pilot flow outlet and a mains flow outlet, a valve member movable between a closed position in which the mains flow outlet is closed and an open position in which the mains flow outlet is open, a motor operable to drive the valve member for movement, and a cooling arrangement.

Such an arrangement of staging valves is advantageous in that the quantity of stagnant fuel in the high temperature core zone can be reduced, thus problems caused by lacquering are reduced. Further, the system is of relatively simple and convenient form, and ensures that there is a reduction in the volume of harmful emissions from the engine.

The motor is preferably an electric motor, for example in the form of a stepper motor. However, other arrangements are possible. For example a piezo electric device may be used to drive the valve member for movement. Such a piezo electric device is advantageous in that it can provide rapid perturbations in fuel flows to the engine burners that can be used to dampen out any instability that may occur in the combustion process.

Control of the arrangement of integrated motor driven staging valves is preferably provided in the form of a staging control unit. Alternatively, appropriate high temperature electronics may be integrated into the design of one or more of the staging valves, which along with the integration of appropriate system condition sensors could be used to provide localised closed loop control of each individual staging valve.

The cooling arrangement preferably comprises a flow passage through and/or adjacent at least part of the motor and through which relatively cool fuel passes, in use. Such an arrangement provides cooling for the motor, thereby reducing the risk of damage thereto resulting from its use in a high temperature environment. This could also be used to provide cooling for electronics if integrated into the design of the valve.

The housing conveniently further includes a pilot flow passage along which fuel from the pilot flow outlet flows, in use, the fuel flow along the flow passage serving to cool at least part of the housing, thus forming at least part of the cooling arrangement.

The invention also relates to a staging valve adapted for use in such a staging valve arrangement.

According to another aspect of the invention there is provided a staging valve comprising a housing having an inlet, a pilot flow outlet and a mains flow outlet, a valve member movable between a closed position in which the mains flow outlet is closed and an open position in which the mains flow outlet is open, a motor operable to drive the valve member for movement, and a cooling arrangement.

The invention will further be described, by way of example, with reference to the accompanying drawings, in which.

Figure 1:
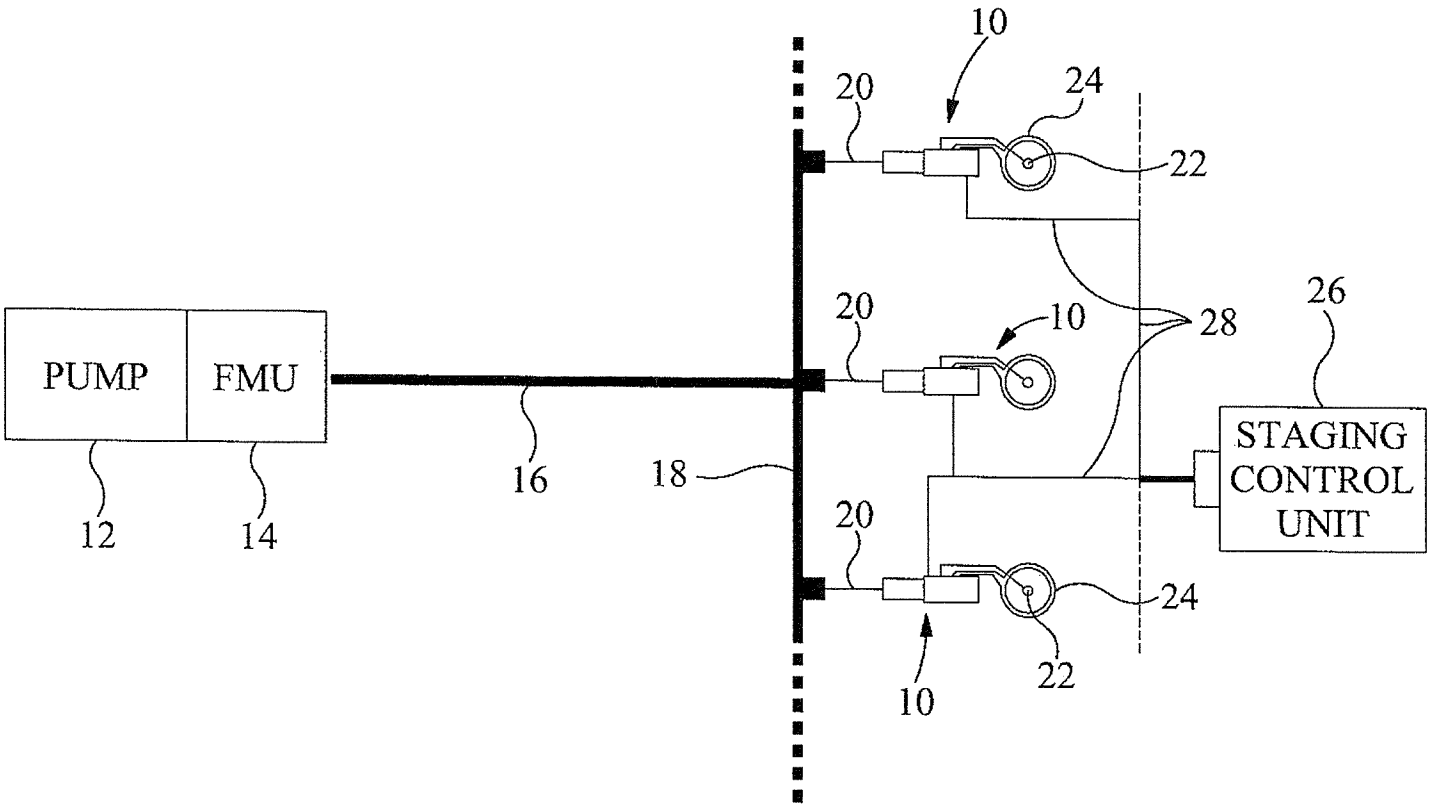
FIG. 1 is a diagram illustrating part of a staging valve arrangement.

The staging valve arrangement illustrated in FIG. 1 comprises a series of, for example, eighteen staging valves 10 each of which is arranged to receive fuel from a fuel pump 12 and associated fuel metering unit 14 via a supply line 16. The supply line 16 is connected to a fuel manifold 18 to which each valve 10 is connected by an associated pig-tail line 20.

Each staging valve 10 controls the delivery of fuel to an associated integrated pilot burner element 22 and to an associated integrated mains burner element 24.

Each staging valve 10 takes the form of a valve member arranged to be driven for movement by an electrically operated motor, and a staging control unit 26 is provided which controls the operation of the motor associated with each valve 10 through power and control lines 28. The control unit 26 may be a stand alone device, for example located in the fancase region of the engine. Alternatively, it could be integrated into a control unit associated with the engine. The interfaces between each of the lines 28 and the respective staging valves 10 have to be hermetically sealed to prevent the possibility of fuel vapour coming into contact with current carrying wires, a potentially hazardous event. The sealing arrangement must be capable of withstanding the high temperature environment of the staging valve, as well as the relatively high internal fuel pressure of the valve, which for a typical staging system can be in excess of 2000 psi.

To negate the need for such hermetic sealing in a harsh environment, the lines 28 could enter the fuel system near the location of the fuel pump 12 and fuel metering unit 14 in the lower temperature environment of the engine fan case. The lines 28 would pass along the inside of the supply line 16 and fuel manifold 18, entering the staging valves via the respective pig-tail lines 20.

To provide an alternative means of controlling the arrangement of staging valves 10, appropriate high temperature electronics could be integrated into the design of one or more of the staging valves. The staging control unit 26 would interface with the integrated electronics via an appropriate data bus to provide the necessary sequencing in the operation of the valves.

Alternatively, the staging valves could be designed as stand alone smart modules with integrated electronic hardware and software. This would negate the need for a separate staging control unit 26 and the associated control lines 28, whilst electrical power to the motor and integrated electronics could be provided along lines running along the inside of the supply line 16, fuel manifold 18 and pig-tails 20, from, for example, an existing power supply module in the engine control unit.

In order to provide localised closed loop control of these smart modules, one or more sensors, such as position or temperature sensors, may be required to provide feedback on one or more operating parameters of the staging valve, fuel system or engine (eg turbine gas temperature). Also, a fuel flow meter could be used to provide analogue, rather than digital, control of the staging valve functionality that could be beneficial in providing a fully adaptive staging system. It is recognised that these sensor feedback elements could also be integrated into the preferred embodiment of the control arrangement incorporating the staging control unit 26.

Figure 2:
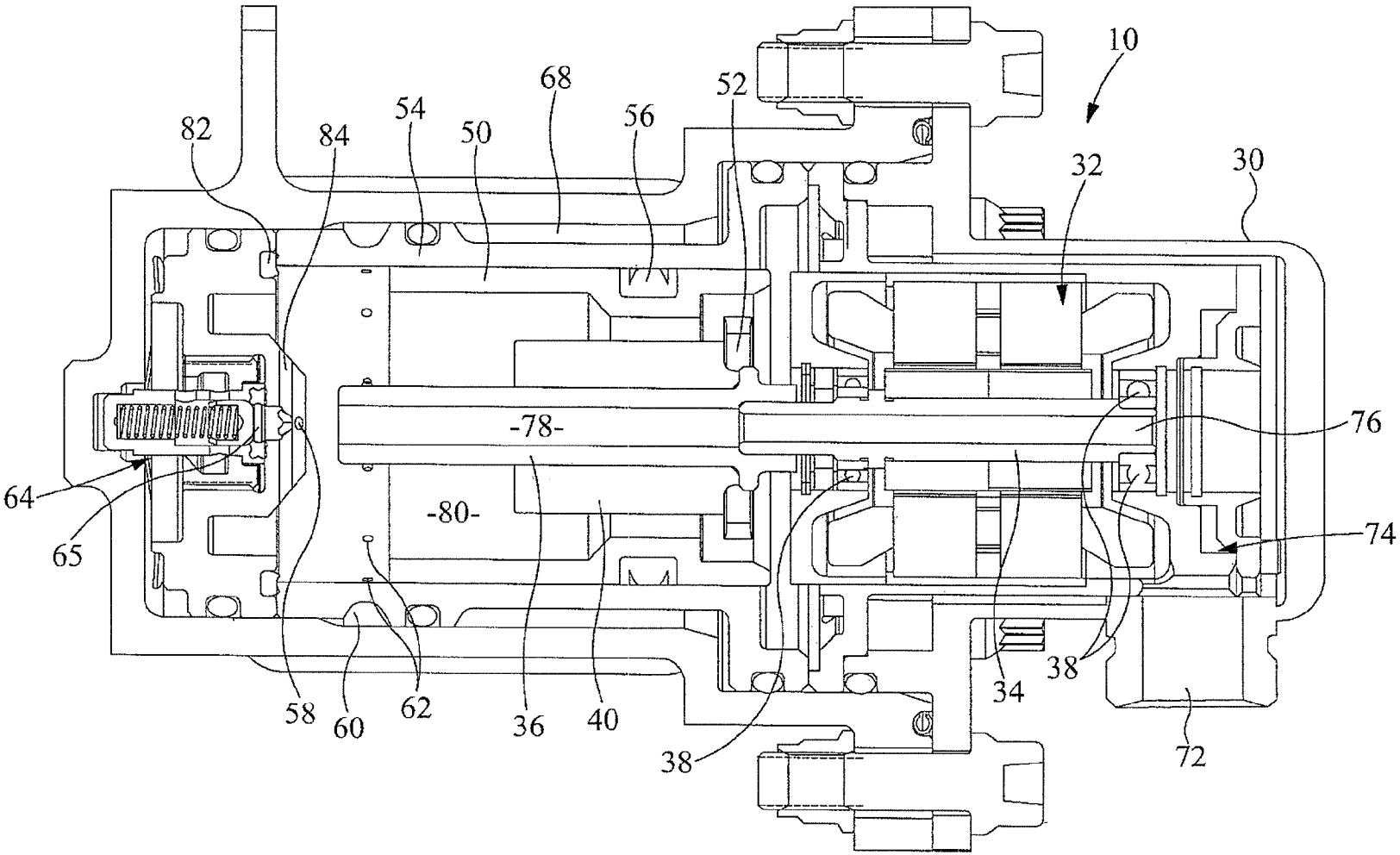
FIGS. 2 and 3 are top and side sectional views illustrating the staging valve of the arrangement of FIG. 1.
Figure 3:
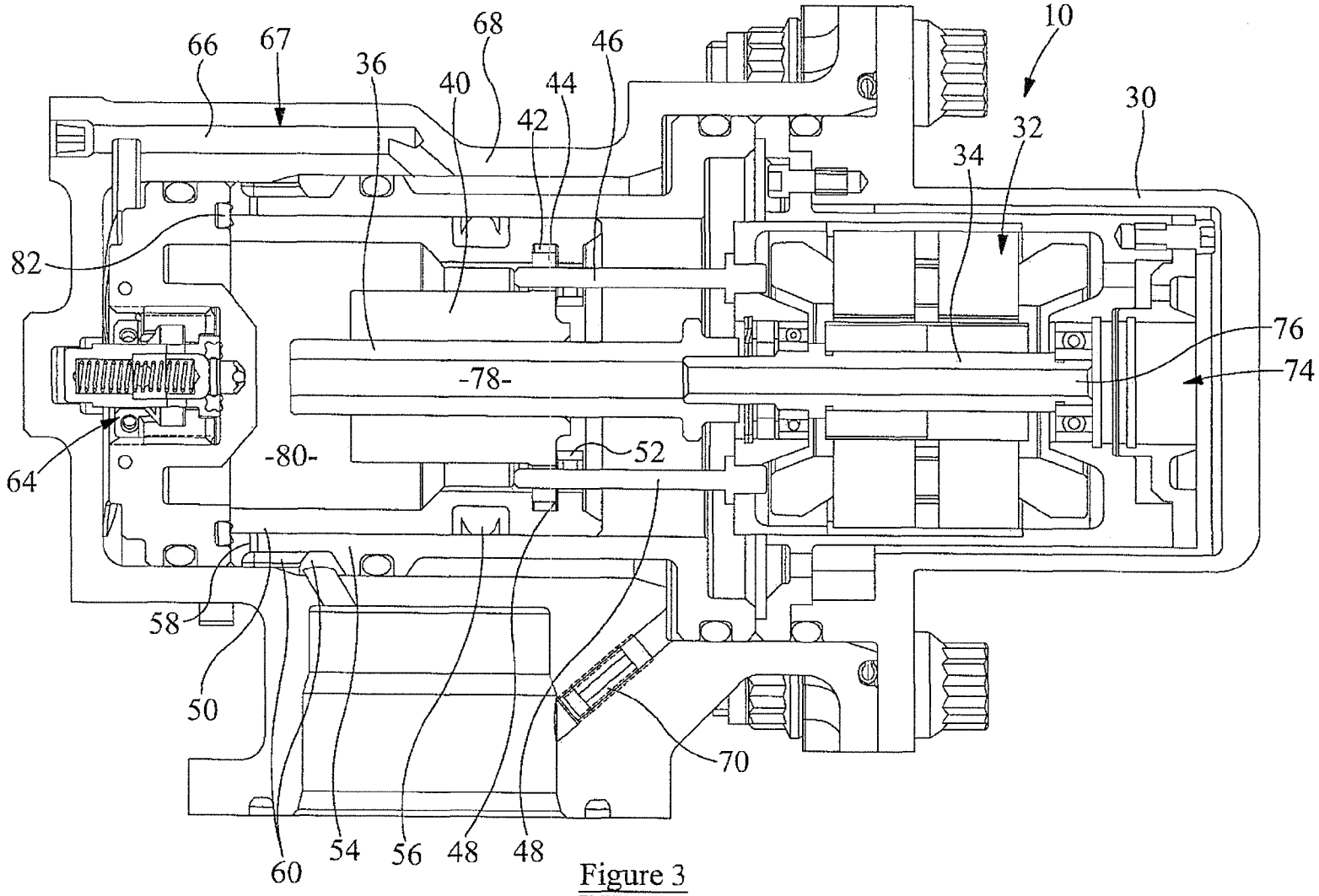

Referring next to FIGS. 2 and 3 there is illustrated one form of staging valve 10 in accordance with the invention. It is recognised that this staging valve 10 will either be mounted on the core of the engine close to the manifold 18 or preferably integrated into the design of the corresponding burner assembly for which the staging valve 10 delivers fuel to associated pilot and mains burner elements 22, 24. The staging valve 10 illustrated in FIGS. 2 and 3 comprises a housing 30 of multi-part form. The housing 30 is of hollow form, and a motor in the form of an electrically powered stepper motor 32 is located therein. The stepper motor 32 includes a rotatable output shaft 34 which is connected to a rotary shaft 36. The shaft 36 is supported entirely by the motor shaft 34 and is thus supported by the bearings 38 which, in use, support the motor shaft 34 for rotation.

The shaft 36 is provided with a screw-thread formation (not shown) which co-operates through a ball or lead screw-type coupling, with a nut 40. As best shown in FIG. 3, the nut 40 includes an outwardly extending flange 42 in which openings or recesses 44 are provided, the openings 44 receiving guide pins 46 mounted to a stationary part of the stepper motor 32. The co-operation between the nut 40 and the guide pins 46 serves to resist angular movement of the nut 40 whilst allowing axial translation thereof to occur.

It will be appreciated that as the nut 40 is held against angular movement, rotation of the motor 32 to drive the shaft 36 for rotation results in axial displacement of the nut 40, the nut 40 translating along the length of the shaft 36.

The flange 42 is received within a recess 48 formed in a cylindrical valve member 50, the co-operation of the flange 42 within the recess 48 being such that translation of the nut 40 along the shaft 36 drives the valve member 50 for axial movement within the housing 30. As with the nut 40, the valve member 50 includes an inwardly extending flange 52 provided with openings through which the pins 46 pass, the pins 46 thus serving to resist angular displacement of the valve member 50 whilst allowing axial translation thereof to occur.

Located within the housing 30 is a valve sleeve 54, an inner periphery of which is of cylindrical form. The valve member 50 slides within the valve sleeve 54, and a dynamic seal member 56 which is carried by the valve member 50 bears against the sleeve 54 to form a seal therebetween. The valve sleeve 54 is formed with a pair of first mains outlet openings 58 which are axially aligned with one another, located diametrically opposite one another on the valve sleeve 54 and which, as illustrated in FIG. 3, open into a passage 60 from which fuel can be delivered, in use, to the mains burner element 24. As illustrated in FIG. 2, the valve sleeve 54 is further provided with a series of second mains outlet openings 62 which are axially aligned with one another and which also open into the passage 60.

At the end of the housing 30 remote from the motor 32 is provided a check valve 64 controlling the passage of fuel between the interior of the valve housing 30 and a pilot flow passage 67 via a pilot outlet opening 65. During all engine operating conditions, apart from shut-down, the check valve 64 is open allowing flow of fuel through the staging valve 10 to the pilot burner element 22. At shut-down the check valve 64 is closed, which prevents fuel in the manifold 18 and pig-tail 20 draining via the staging valve 10 to the pilot burner element 22, providing a drip tight seal from the pig-tail 20 to the pilot burner element 22, and ensuring that the manifold 18 and pig-tail 20 are primed with fuel for the next start-up. The pilot flow passage 67 is of multi-part form comprising, in part, drillings 66 formed in the housing 30, but also including a region defined by a chamber 68 formed between the housing 30 and the valve sleeve 54. Located within one of the drillings 66 of the passage 67 is a flow restrictor or trimmer device 70 which is preferably adjustable, prior to installation of the staging valve 10, to allow the series of staging valves 10 associated with a particular engine to be matched to one another such that a consistent set of fuel flow restriction paths, commonly referred to as flow number, is provided from the manifold 18 to the pilot burner elements 22, and hence a consistent pilot burner combustion pattern is achieved.

The housing 30 includes a fuel inlet 72 through which fuel is delivered to the interior of the housing 30. The fuel delivered in this manner flows into a chamber 74 within which the motor 32 is located, thereby drowning the motor 32 in fuel. Fuel is also able to flow through a passage 76 formed centrally through the shaft 34 of the motor 32, the fuel then flowing through a hollow interior 78 of the shaft 36 to a chamber 80 within which the valve member 50 is located and into which the pilot and mains outlet openings 58, 62, 65 open, depending upon the position of the valve member 50.

With the valve member 50 in a closed position as illustrated in FIG. 3, the valve member 50 closes the first and second mains outlet openings 58, 62, thus fuel is unable to flow to the passage 60 and from there to the mains burner element 24. Indeed the operation of the dynamic seal member 56 and the engagement of the end of the valve member 50 with a further seal member 82 located at the end of the chamber 80 serves to ensure that any leakage of fuel from either of the chambers 74, 80 to the passage 60 is prevented, thus providing a drip tight seal to the mains burner element 24.

Although in this position fuel is unable to flow to the passage 60 and from thereto the mains burner element 24, fuel is able to flow from the chamber 80 through the check valve 64, via the inlet passage 84 shown in FIG. 2 to the passage 67. The fuel flowing through the passage 67 passes to the pilot burner element 22. It will be appreciated that the flow of fuel through and around the motor 32 serves to maintain the motor 32 at a relatively low temperature. Reliable operation of the motor 32 is thus maintained even in the harsh environmental conditions in which the motor 32 is located. It will also be appreciated that this flow of fuel could also be used to maintain any electronics, that have been integrated into the design of the staging valve, at a relatively low temperature. Further, the flow of fuel through the passage 67 and chamber 68 serves to cool the valve 10, minimising the risk of lacquering of the fuel within the chamber 80.

From the closed position illustrated in FIG. 3, operation of the motor 32 to drive the valve member 50 for movement within the housing 30 will result in the valve member 50 moving to an intermediate, open position in which the two first outlet openings 58 are no longer covered. It will be appreciated that once this position has been reached, fuel delivery through the staging valve 10 will occur both via the pilot burner element 52 and also via the mains burner element 24 at a relatively restricted rate. During this mode of operation, the continued flow of fuel around and through the motor 32 will serve to maintain the motor 32 at a sufficiently low temperature that it will continue to operate normally. Further, the continued flow of fuel through the passage 67 and chamber 68 serves to maintain the temperature of fuel within the chamber 80 at a relatively low level, again minimising the risk of fuel lacquering.

From this intermediate position, the valve member 50 can be driven to a fully open position illustrated in FIG. 2 in which in addition to the outlet openings 58 being uncovered, the series of second outlet openings 62 are also open. In this position, fuel delivery to the mains burner element 24 increases to a higher rate. Again, fuel will continue to be delivered through the pilot burner element 22, thus cooling of the motor and valve will be maintained. Typically, for example, the fully open position will be used during high demand conditions such as during take off and climb conditions, the part-open position will be used during lower demand conditions such as cruise, and the closed (pilot flow only) position will be used under engine idle and descent conditions.

If it is desired to reduce or terminate the delivery of fuel through the mains burner element 24, then the motor 32 is driven in the reverse direction to return the valve member 50 towards the position illustrated in FIG. 3, covering either just the series of second outlet openings 62 or both series of outlet openings 58, 62.

It will be appreciated that the provision of the second outlet openings 62 in the form of a ring of small openings means that the distance through which the valve member 50 is moved, in use, between its extreme positions is minimised, thereby reducing the size of the valve and any stagnant fuel volumes.

In use, the high temperature core zone of the engine in which the staging valves 10 are located can have an ambient air temperature in excess of 200° C. In order to ensure that the stepper motor 32 can continue to operate normally and reliably, the internal temperature of the staging valves 10 should ideally not exceed 150° C. Likewise, the temperature should not exceed 150° C. in order to avoid fuel lacquering within the staging valve 10, and to maintain the ability of the valve member 50 to move and seal correctly. As described hereinbefore, the manner in which the stepper motor 32 is drowned within relatively cool fuel and has relatively cool fuel passing along at least the interior 76 thereof ensures that the motor temperature is maintained at a sufficiently low level to avoid damage to the motor. Further, the continual flow of fuel along the pilot flow passage 67 serves to cool the valve member 50 and seals 56, 82, and maintains the internal temperature of the chamber 80 at a sufficiently low level, below 150° C., that fuel lacquering is avoided, and valve operation and sealing efficiency is maintained. The design of the valve housing 30, chamber 80 and associated passages is also such that there is minimum stagnant fuel volume located therein, in particular the size of the passage 60, through which fuel flows to the mains burner element 24, is minimised.

The provision of two sets of outlet openings 58, 62 through which fuel is delivered to the mains burner element 24 is advantageous in that in the event of any instability occurring in the combustion process during any engine operating condition the position of the valve member 50 can be altered as required to adjust the proportion of fuel supplied to the mains and pilot burner elements 24, 22 and alleviate the instability.

The nature of the check valve 64 is such that, during all operating modes, the check valve 64 will be open thus fuel will flow through the pilot flow passage 66 and chamber 68 at any time when fuel is being delivered to the staging valve 10, regardless as to whether the valve member 50 is in its closed, partially open or fully open position. Consequently, cooling of the valve and motor occurs at all times that fuel is being supplied through the valve.

It is envisaged that the position of the valve member 50 can be determined by noting the position of the stepper motor 32. As a result, it is thought that no position sensors to provide a separate indication of the position of the valve member will be required. However, should progressive, closed loop control of the valve member be required, rather than the tri-position control described hereinbefore, it may be necessary to integrate a position feedback device, such as a Linear Variable Displacement Transducer (LVDT), into the design of the valve. This device would provide a signal to the staging control unit indicative of the position of the valve member 50. Alternatively a rotary variable differential transducer (RVDT) may be provided for this purpose. For example, it may be arranged to monitor the position of the motor output shaft and hence the position of the valve.

The staging valve 10 described hereinbefore, and illustrated in FIGS. 2 and 3, takes the form of a conventional linear piston and sleeve type arrangement. It is recognised that the valve could be of rotary form, similar to that described in EP 1903416, with the stepper motor driving the valve via an integrated gear box, rather than the ball or roller screw arrangement described hereinbefore.

Although the use of a stepper motor 32 is described herein, it will be appreciated that other forms of motor could be used to drive the valve member 50 for movement. For example, it may be possible to use a piezo electric device to drive the valve member 50 for movement. The use of such a high precision actuating device would enable the staging control, in the form of a stand alone unit or as high temperature electronics, integrated into the design of the staging valve 10, for example, to command rapid perturbations in the fuel flow to the pilot or mains burner elements 22, 24 that could be used to dampen out any instability that may occur in the combustion process (ie mitigation of the aforementioned combustor rumble).

In the arrangement described hereinbefore, the valve member 50 serves only to control whether or not fuel is delivered to the mains burner element 24. The valve member 50 does not control the delivery of fuel through the pilot passage 67 to the pilot burner element 22. However, this need not always be the case, and an arrangement is envisaged in which the pilot check valve 64 is replaced by a pilot valve arrangement operable under the control of the motor 32. This is advantageous in that with the arrangement described hereinbefore the pilot check valves 64 in each staging valve 10 on a particular engine need to be accurately matched to ensure that there is consistent and uniform operation of the pilot burner elements 22 around the combustor. Any variation in the operation of the pilot check valves 64 could potentially result in, for example, a sudden reduction in fuel flow to the pilot burner elements 22 during a lean burn control operation condition of the engine (ie descent) and a subsequent lean burn blow-out event which is undesirable. With each staging valve 10 having a controllable pilot valve arrangement instead of a pilot check valve, the fuel flow to the pilot burner elements 22 can be accurately controlled at all engine operating conditions, not only preventing the aforementioned lean burn blow-out condition but also ensuring that over-fuelling does not occur during, for example, engine start-up. Such an arrangement may also permit the trimmer devices 70 to be omitted.

It will be appreciated that a wide range of modifications and alterations may be made to the arrangements described hereinbefore without departing from the scope of the invention. For example a number of different routings for the passage 67 to achieve a desired level of cooling or to enhance cooling of specific parts of the valve may be possible. However, a range of other modifications and alterations are also possible.

The invention claimed is:

1. A gas turbine configured with a staging valve comprising a housing having an inlet, a pilot flow outlet which is configured to feed fuel to a pilot burner of the gas turbine, a first mains flow outlet which is configured to feed fuel to a main burner of the gas turbine, and a second mains flow outlet which is configured to feed fuel to the main burner, a valve member, a motor operable to drive the valve member for movement, and a cooling arrangement, wherein the valve member is movable by the motor between a closed position in which the first and second mains flow outlets are closed, an intermediate position in which the first mains flow outlet is open and the second mains flow outlet is closed, and a fully open position in which the first and second mains flow outlets are open.

2. A staging valve according to claim 1, wherein the motor is one of an electric stepper motor and a piezo electric device.

3. A staging valve according to claim 1, wherein the cooling arrangement comprises a flow passage through or adjacent to at least part of the motor and through which relatively cool fuel passes, in use.

4. A staging valve according to claim 1, wherein the housing further includes a pilot flow passage along which fuel from the pilot flow outlet flows, in use, the fuel flow along the pilot flow passage serving to cool at least part of the housing, thus forming at least part of the cooling arrangement.

5. A staging valve according to claim 1, further comprising high temperature electronics to provide localised closed loop control of the staging valve.

6. A staging valve arrangement comprising an arrangement of the staging valves of claim 1 that are located, in use, in the high temperature core zone of an engine.

7. An arrangement according to claim 6, wherein each staging valve is integrated into the design of a corresponding burner assembly located on the engine combustor.

8. An arrangement according to claim 6, further comprising a staging control unit operable to control the operation thereof.

9. An arrangement according to claim 6, wherein high temperature electronics are integrated into the design of one or more of the staging valves to provide localised closed loop control of each individual staging valve.

* * * * *